US011417243B2

(12) United States Patent
Bucco

(10) Patent No.: US 11,417,243 B2
(45) Date of Patent: Aug. 16, 2022

(54) POP-UP WITH LOCK MECHANISM

(71) Applicant: American Greetings Corporation, Cleveland, OH (US)

(72) Inventor: Joseph Bucco, Highland Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 17/074,828

(22) Filed: Oct. 20, 2020

(65) Prior Publication Data

US 2022/0122487 A1 Apr. 21, 2022

(51) Int. Cl.
*G09F 1/06* (2006.01)

(52) U.S. Cl.
CPC ..... *G09F 1/065* (2013.01)

(58) Field of Classification Search
None
See application file for complete search history.

(56) References Cited

U.S. PATENT DOCUMENTS 990,918 A * 5/1911 Stadler ..... A63H 33/38 446/148
1,684,244 A * 9/1928 Richardson ..... B65D 5/4225 229/116.3
1,735,009 A * 11/1929 Moore ..... G09F 1/08 108/100
2,075,657 A * 3/1937 Powers ..... A47F 5/112 229/102.5
2,099,015 A * 11/1937 Horr ..... G09F 1/06 40/539
2,100,403 A * 11/1937 Mancuso ..... G09F 1/08 40/539
2,113,238 A * 4/1938 Ouwerkerk ..... G09F 1/08 40/124.08
2,120,472 A * 6/1938 Rosenak ..... G09F 1/08 40/124.17
2,149,959 A * 3/1939 Gilbert ..... G09F 1/06 40/539
2,173,251 A * 9/1939 Freedman ..... G09F 1/08 40/539
2,441,333 A * 5/1948 Reinsberg ..... A47F 7/06 40/539
2,601,374 A * 6/1952 Ditzler ..... A47F 3/14 40/539
6,347,772 B1 * 2/2002 L'Hotel ..... G09F 1/06 206/45.24
7,395,622 B2 7/2008 Malkovas
9,123,262 B1 * 9/2015 Frost ..... B31D 5/04
9,475,333 B2 10/2016 Yeh
(Continued)

*Primary Examiner* — David R Dunn
*Assistant Examiner* — Christopher E Veraa
(74) *Attorney, Agent, or Firm* — Christine Flanagan

(57) ABSTRACT

A pop-up structure with a lock mechanism that functions to retain the pop-up structure in an unfolded or fully erect configuration. The lock mechanism contains a base panel, main panel, locking tab and one or more stopper mechanisms. The lock mechanism interacts with the pop-up structure and is mainly contained within a cavity of the pop-up structure. The lock mechanism can be accessed through an opening in a base. Users may move a lock tab clockwise to retain the pop-up structure in an open position and then move the lock tab counterclockwise to close the pop-up structure.

18 Claims, 6 Drawing Sheets

(56) References Cited

U.S. PATENT DOCUMENTS

| | | | | |
|---|---|---|---|---|
| 9,836,997 | B1 | 12/2017 | Bandrup | |
| 9,842,516 | B2 | 12/2017 | Yeh | |
| 2005/0081412 | A1 | 4/2005 | Malkovas | |
| 2017/0249874 | A1* | 8/2017 | Lopez Fern Ndez ..... | A47F 5/11 |
| 2019/0329145 | A1* | 10/2019 | Simmons ..... | A63H 33/38 |
| 2021/0233432 | A1* | 7/2021 | Enriquez ..... | G09F 1/065 |

* cited by examiner

POP-UP WITH LOCK MECHANISM

RELATED APPLICATIONS

There are no inventions related to this invention.

FIELD OF THE INVENTION

The present invention is in the field of social expression products such as greeting cards or pop-up structures. More specifically, the present invention is directed to a lock mechanism which can be used with a pop-up structure to retain the pop-up structure in an unfolded or fully erect state.

SUMMARY OF THE INVENTION

In one embodiment, the present disclosure and related inventions is directed to a locking mechanism for a 3D pop-up structure comprising a base panel attached to a lower surface of a 3D pop-up structure, the base panel having an opening at the center thereof, a main panel which extends upward from and perpendicular to the base panel and into an internal cavity of the 3D pop-up structure, a locking tab which interlocks with the main panel such that the locking tab is partially movable with respect to the main panel, and one or more stopper mechanisms located with the internal cavity of the 3D pop-up structure and which are operative to limit the movement of the locking tab with respect to the main panel, wherein the locking tab is operative to move and retain the 3D pop-up into a fully erect position.

In another embodiment, the present disclosure and related inventions is directed to a pop-up greeting card with lock mechanism comprising a pop-up structure that is operable to move between a first position wherein the pop-up structure is in a substantially flat or two-dimensional configuration and a second position wherein the pop-up structure is in an erect three-dimensional configuration, a lock mechanism attached to a bottom surface of the pop-up structure, the lock mechanism comprising a base panel, a main panel which extends upward from the base panel, and a locking panel which attached to the main panel, wherein when the pop-up structure is in the first position, the locking tab is parallel with the main panel and when the pop-up structure is in the second position, the locking can be moved such that it is perpendicular to the main panel and therefore retain the pop-up structure in the first position.

In still another embodiment, the present disclosure and related inventions is directed to a pop-up greeting card comprising a pop-up structure, a lock mechanism contained within the pop-up structure, the lock mechanism comprising a base, and a main panel attached to the base and a lock tab which is in contact with the main panel, wherein the pop-up structure can move between a first position wherein it is folded and substantially flat and a second position wherein the pop-up structure is unfolded and fully erect, and wherein the lock tab can be moved from a first position wherein it lies flat within the pop-up structure and parallel with the main panel and a second position wherein it is perpendicular to the main panel and it retains the pop-up structure in the second position.

DETAILED DESCRIPTION OF PREFERRED AND ALTERNATE EMBODIMENTS

Figure 2:
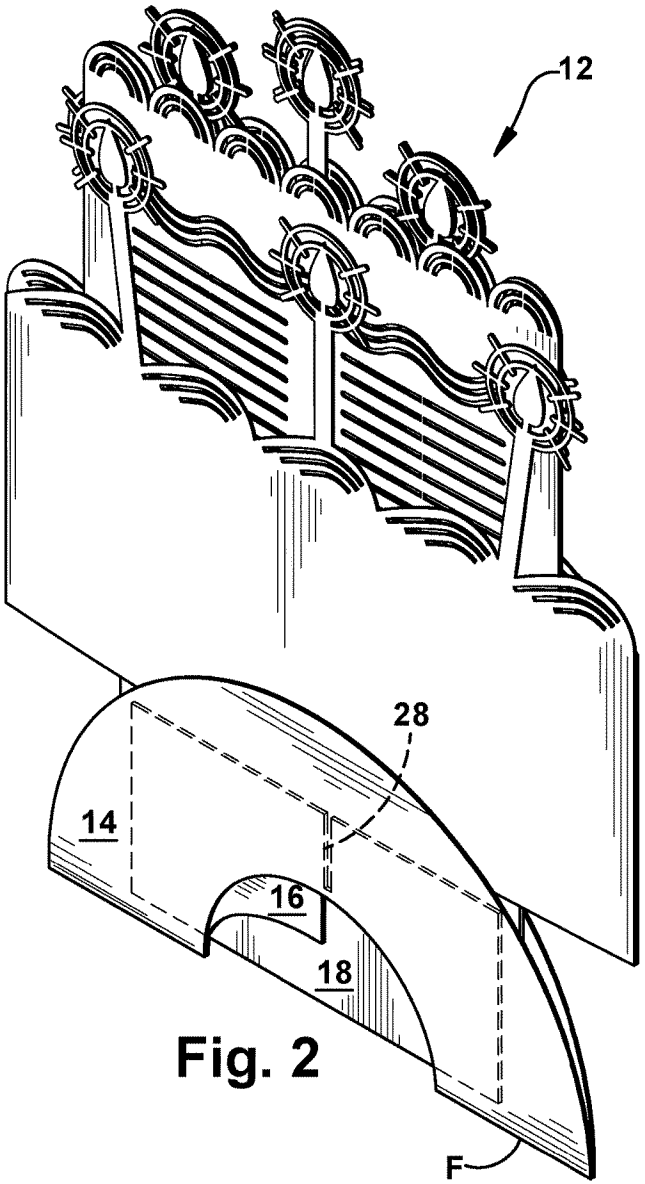
FIG. 2 is a perspective view of a greeting card with the turn lock mechanism of FIG. 1 in a closed position.

The turn lock mechanism 10 for a three-dimensional (3D) pop-up structure 12 of the present disclosure and related inventions provides means to easily hold or "lock" free-standing or stand-alone 3D pop-ups in an open or unfolded position for display.

A free-standing or stand-alone pop-up structure 12 may be used as a greeting card, advertisement, display, ornament, novelty keepsake or other such item. It may be constructed to form a 3D structure, such as, for example, as shown in the figures, a cylindrical structure, such as a tiered cake. The shape of the 3D pop-up structure 12 is optional and can be greatly varied according to theme, purpose, visual effect, etc. The 3D pop-up 12, as described herein, is operable to move from a first position, wherein the 3D pop-up 12 is in a folded or substantially flat, two-dimensional (2D) configuration (see FIG. 2) and a second position, wherein the 3D pop-up 12 is in an unfolded, three-dimensional, fully erect or upright configuration (see FIG. 1). The first position allows the 3D pop-up to 12 be flattened to facilitate placement into an envelope. When the 3D pop-up 12 is in the second position, a novel lock mechanism 10 can be used to brace the 3D pop-up 12 in an expanded, self-supported state. The 3D pop-up structure 12 may contain a plurality of panels, tabs and such, perhaps foldable with respect to one another and interoperable to form the 3D structure.

The turn lock mechanism 10 of the present disclosure and related invention, which is substantially concealed within the inner cavity of the 3D pop-up structure 12, includes a base panel 14, a main panel 16, a locking tab 18, and one or more stopper tabs or mechanisms 20. The base panel 14 serves as the base or platform for the entire 3D pop-up structure 12. The base panel 14 contains an upper surface and a lower surface opposite the upper surface. The lower surface is what comes into direct contact with the surface upon which the 3D pop-up structure 12 is placed. It also has an opening or aperture 22 at the direct center of the base 14. In the embodiment shown in the figures, the base 14 is circular shaped, with a circular opening 22 at the center thereof. However, in other embodiments, the base structure 14 may be shaped like a square, rectangle, or any other conceivable shape. The base 14 of the turn lock mechanism 10 also contains a fold line F which extends across an axis of symmetry of the base panel 14, creating two equal halves—a first half and a second half, of the base panel 14. The base panel 14 can be folded along this fold line F such that each half of the base panel is positioned with one half atop the other half with the upper surface of a first half facing the upper surface of the second half.

Figure 11:
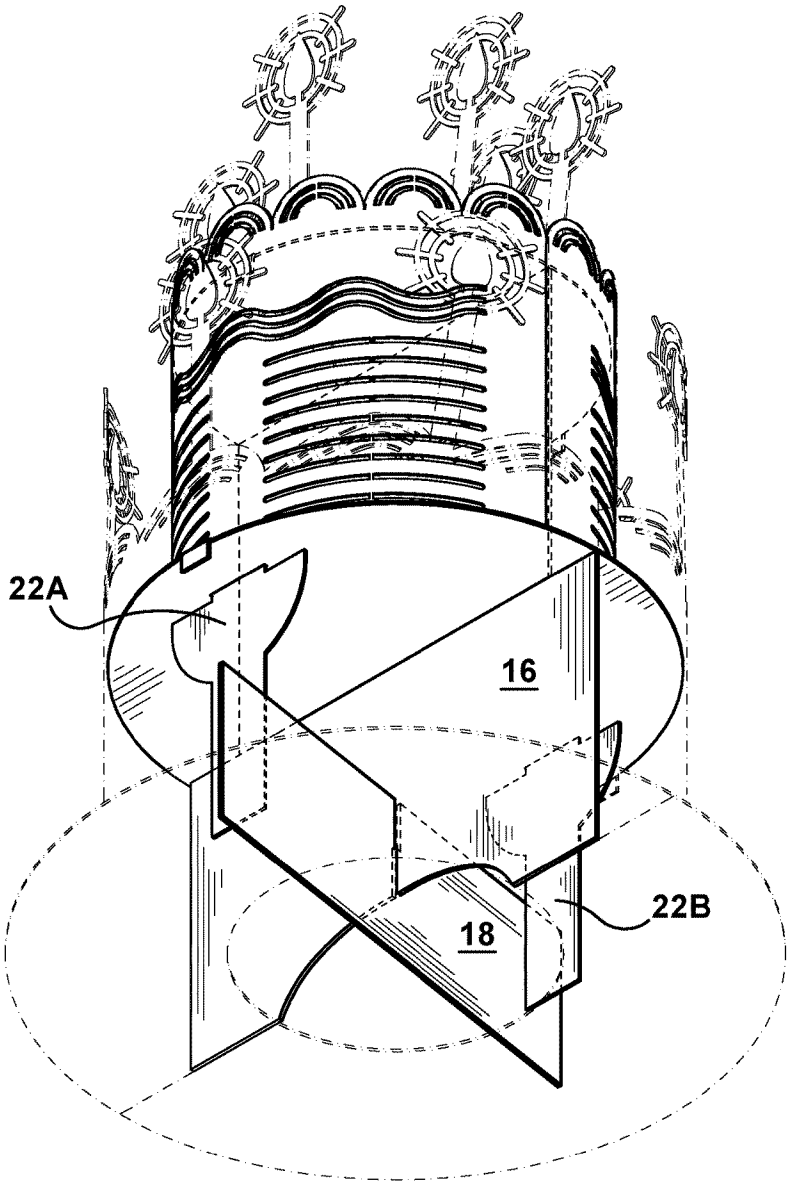
FIG. 11 is a bottom perspective view of the greeting card of FIG. 1, showing the stopper tabs.

The main panel 16 of the turn lock mechanism 10 attaches to the base panel 14 via a support panel 24. The support panel 24 contains an upper surface and a lower surface opposite the upper surface. The lower surface of the support panel 24 is attached directly to the upper surface of the turn lock mechanism's base panel 14. The support panel 24 also contains an opening or aperture therein which corresponds with the location of the opening or aperture 22 in the base panel 14 of the turn lock mechanism 10. The support panel 24 extends upward along the fold line F on the lock mechanism base panel 14 to form the main panel 16 that extends into the opening or cavity formed by the 3D pop-up structure 12 (when in the second, unfolded position). The main panel 16 width extends from one side of the base 14 to the opposing side of the base 14 with an arched or arcuate shape therebetween, as shown in FIG. 11. A slit 26 is contained on the main panel 16 which extends upward from a bottom edge of the main panel 16 (that can be seen through the opening or apertures in the lock mechanism base panel 14 and the support panel 24). The slit 26 is located at the approximate center of the support panel 24 and extends upward for approximately ¼-½ inches. When the 3D pop-up structure 12 is in the first, folded position, the main panel 16 of the lock mechanism 10 is positioned between the first and second halves of the lock mechanism base panel 14. As noted above the center panel extends into the opening or cavity of the 3D pop-up structure 12, when the 3D pop-up structure 12 is in the second or unfolded position, as shown in FIG. 11. It may also interoperate with other tabs, panels, or parts of the 3D pop-up structure 12.

A locking tab 18 works with the main panel 16 of the lock mechanism 10 to maintain the 3D pop-up 12 in an open or upright position (second position), as shown in FIGS. 1, 3, 7 and 10. The locking tab 18 has a width equal to the width of the main panel 16 of the lock mechanism 10. The height of the locking tab 18, in the embodiment shown in the figures is between 1-2 inches, however, the height of the locking tab 18 may vary according to the size of the pop-up structure 12. The locking tab 18 contains a slit 28 extending from a top or upper edge thereof down approximately ¼-inch, however the size of the slit 28 may vary as well. The slit 28 in the locking tab 18 is inserted into the slit 26 on the main panel 16 of the turn lock mechanism 10. The locking tab 18 can then move from a first position, wherein it is parallel to and in contact with the main panel 16 and a second position wherein the locking tab 18 is moved into a position where it is perpendicular to the main panel 16.

Figure 4:
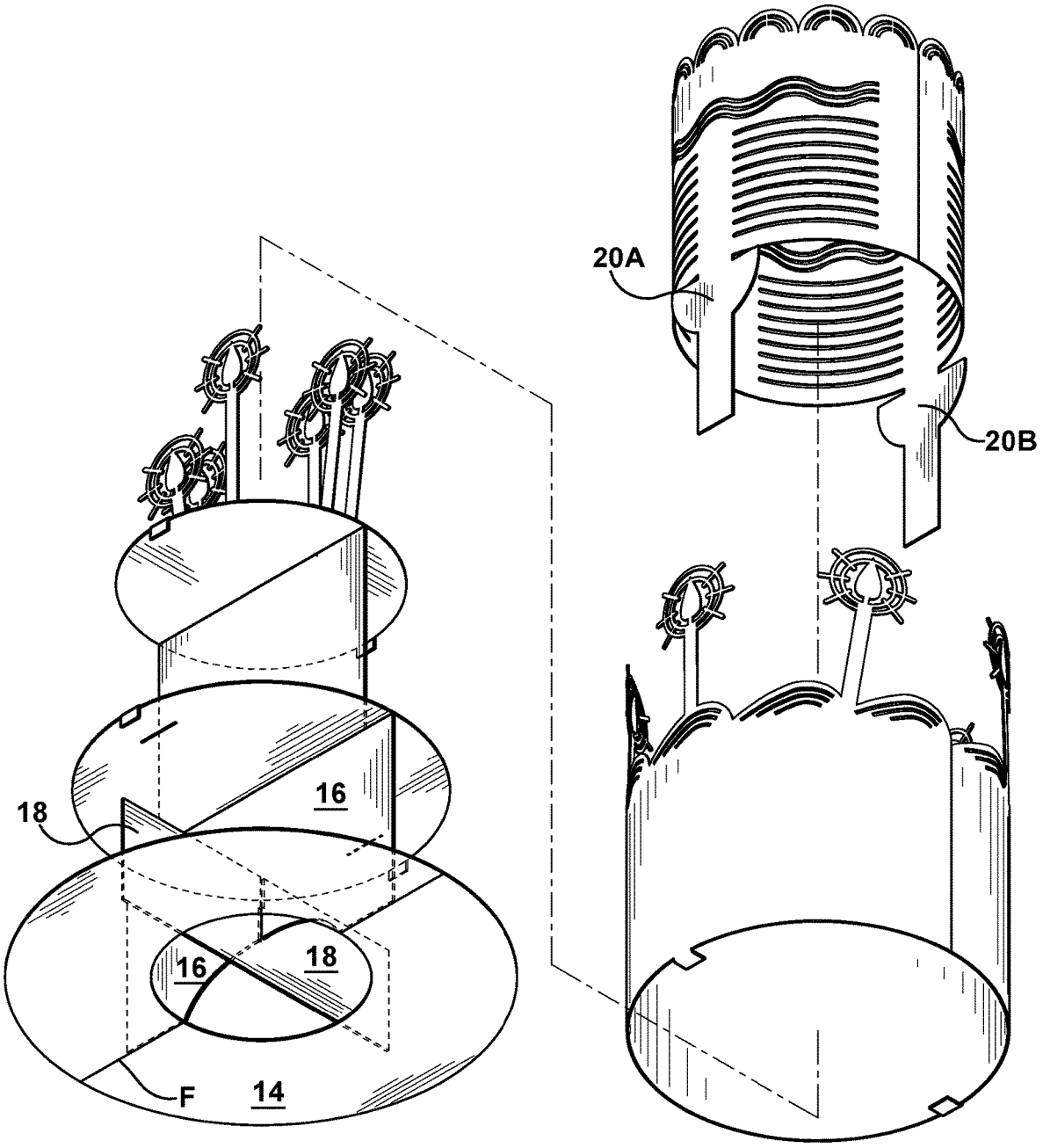
FIG. 4 is an exploded view of the greeting card of FIG. 1.
Figure 7:
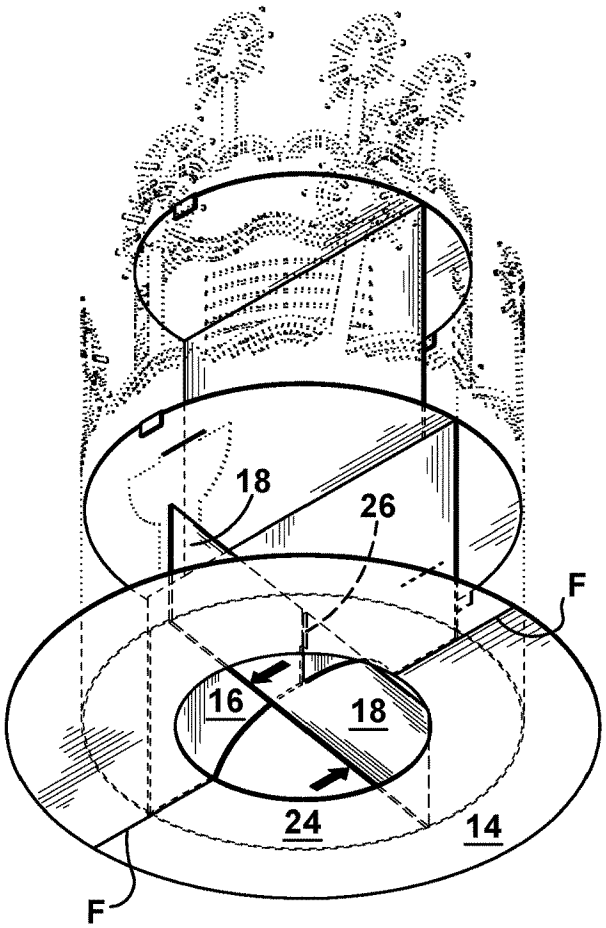
FIG. 7 is a bottom perspective view of the greeting card of FIG. 1, in an open position.
Figure 6:
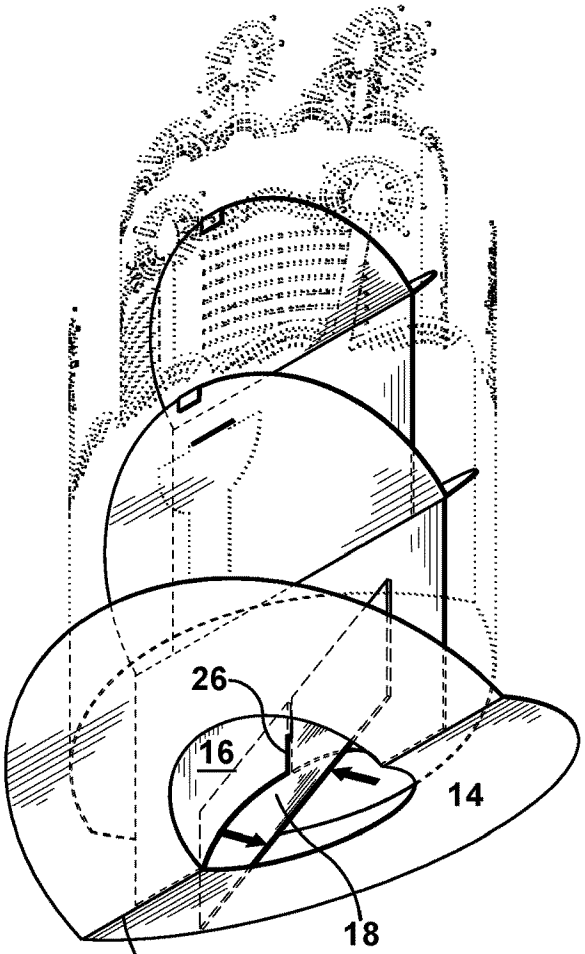
FIG. 6 is a bottom perspective view of the greeting card of FIG. 1, in a semi-open position.

One or more stopper tabs 20 are located on the inside surface of the 3D pop-up structure 12, as shown in FIGS. 4 and 11. In the embodiment shown in the figures, there is a first stopper tab 20A located on one side of the inner surface of the 3D pop-up structure 12 and a second stopper 20B directly across and opposite of the first stopper 20A. Both the first stopper tab 20A and second stopper tab 20B are substantially t-shaped. The stopper tabs 20 operate to stop the locking tab 18 from moving more than ½ turn. As noted above, when the 3D pop-up structure 12 is in the first position, it is folded and substantially flat and the locking tab 18 is parallel to the main panel 16 (see FIGS. 2 and 5). Also, when folded in the first position, the locking tab 18 is visible and accessible through the opening or aperture in the base panel 14. To move the 3D pop-up structure 12 into the second or unfolded, erect position, a user can grasp the locking tab 18, such as between a thumb and forefinger and turn the locking tab 18 approximately ½ turn (until the locking tab 18 movement is stopped by the stopper panel(s) 20) wherein it is then in a perpendicular position with respect to the main panel 16 (see progression in FIGS. 5-7 and 8-10). This positioning allows the 3D pop-up structure 12 to remain in the second or unfolded and fully erect position. To collapse the 3D pop-up structure 12 or move it from the second position back to the first position, the user can turn the locking tab 18 back ½ turn until it is again parallel with the main panel 16 of the turn lock mechanism 10.

Figure 1:
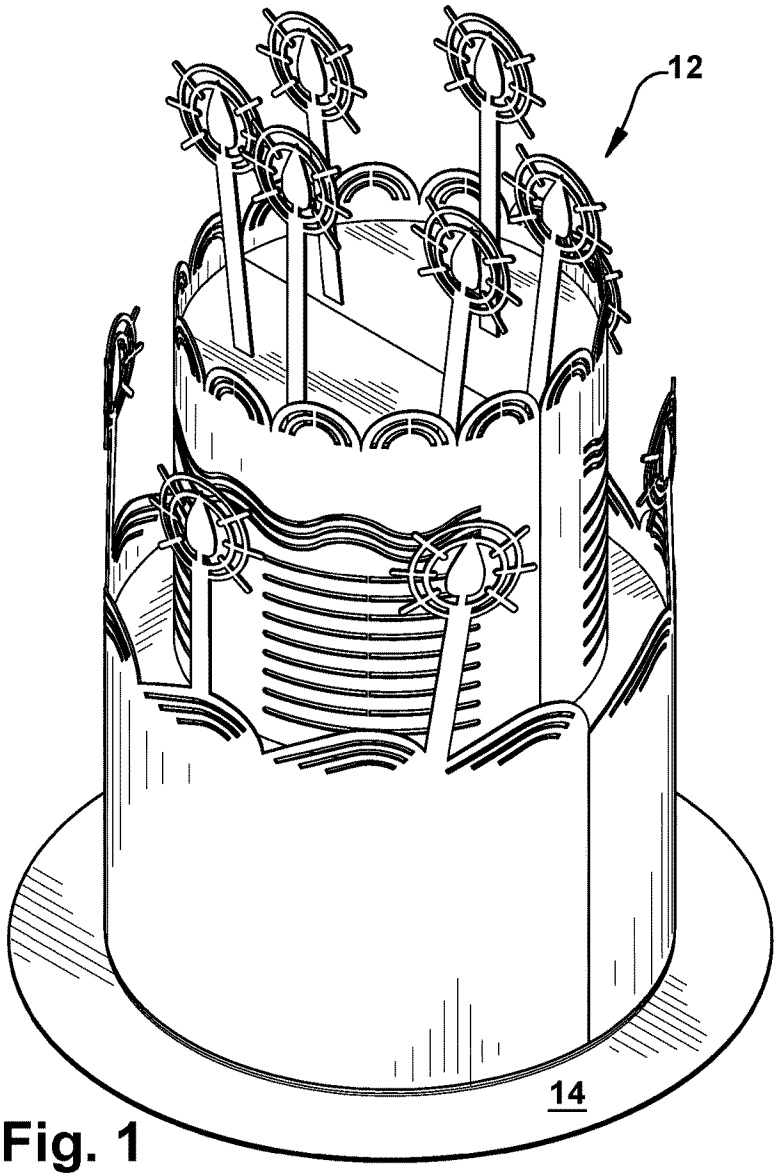
FIG. 1 is a perspective view of a greeting card with turn lock mechanism of the present invention, in an open position.
Figure 3:
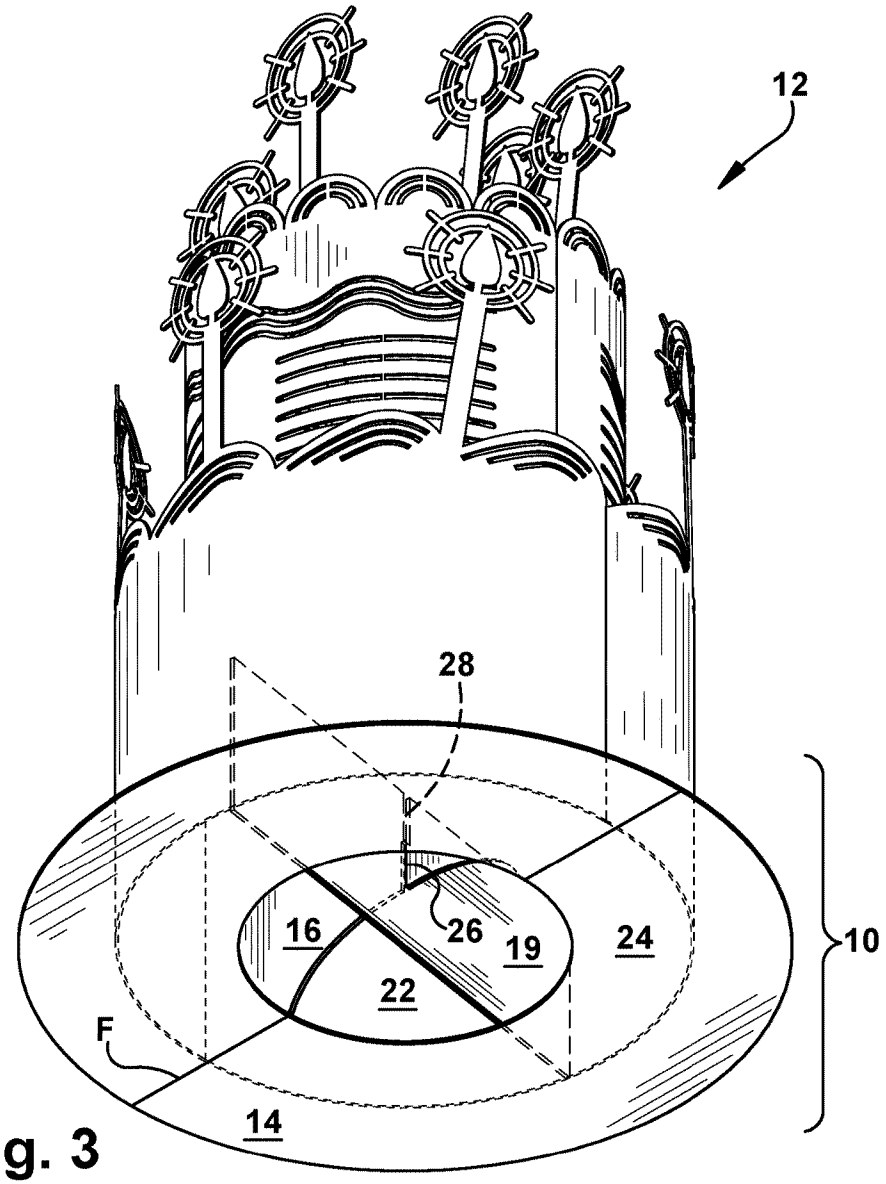
FIG. 3 is a bottom up view of the greeting card of FIG. 1.
Figure 5:
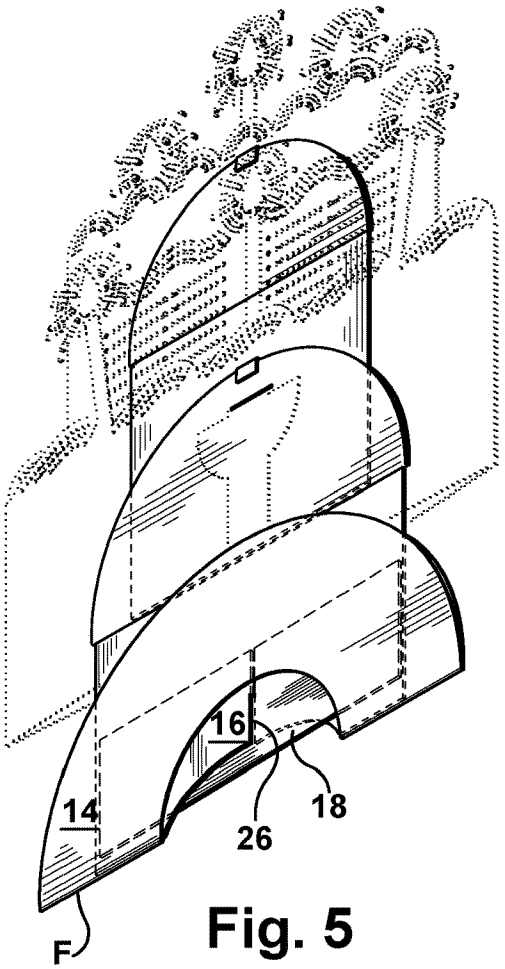
FIG. 5 is a bottom perspective view of the greeting card of FIG. 1, in a closed position.
Figure 10:
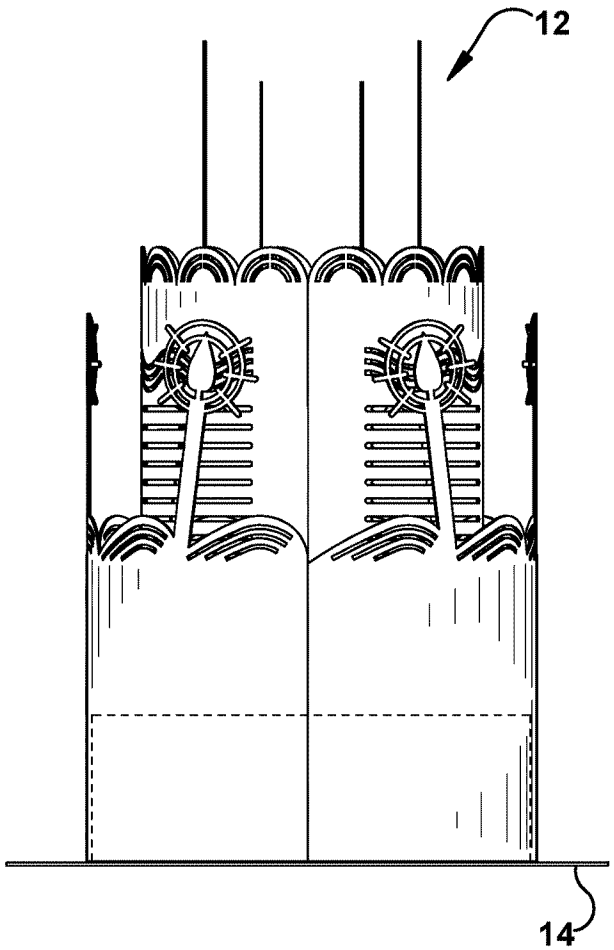
FIG. 10 is a right side view of the greeting card of FIG. 7.
Figure 9:
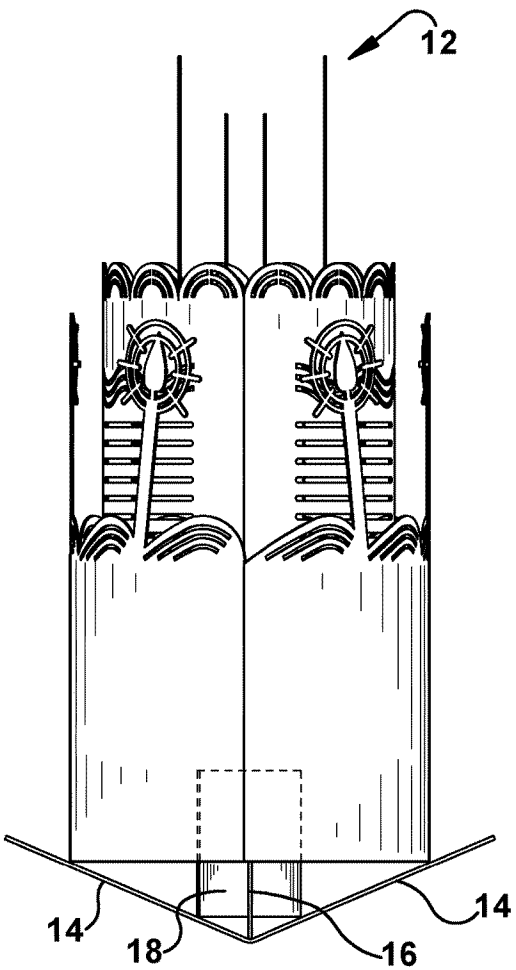
FIG. 9 is a right side view of the greeting card of FIG. 6.
Figure 8:
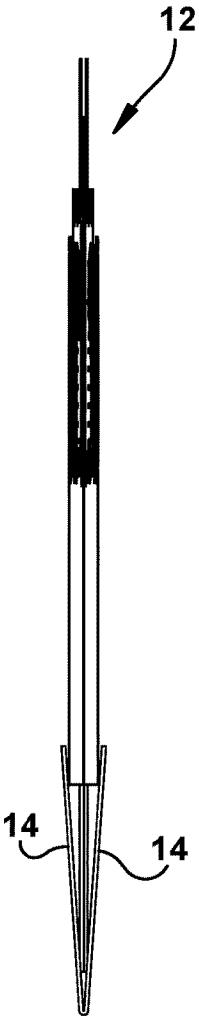
FIG. 8 is right side view of the greeting card of FIG. 5.

In operation, the 3D pop-up structure 12 is in a first position, wherein it is collapsed, folded and in a substantially flat or 2D configuration, as shown in FIGS. 1, 3 and 10. This facilitates mailing the 3D pop-up 12 in an envelope or shipping and/or storing the 3D pop-up 12 in a flat, space-saving position. To unfold, open or expand the 3D pop-up 12 the user can simultaneously gently squeeze two sides of the 3D pop-up 12 (along fold line F) with one hand while grasping the locking tab 18 (accessed at the center of the base panel 14 through the opening therein) with the thumb and forefinger of the other hand and turning the locking tab 18 in a clockwise direction for approximate ½ turn or until the locking tab 18 is stopped by the stopper tab(s) 20. This places and locks the 3D pop-up structure 12 into a fully erect position wherein it can be put on display, as shown in FIGS. 2, 5 and 8. To return the 3D pop-up 12 to the first, flat or folded position, the user can grasp the locking tab 18 and turn it counterclockwise for approximately ½ turn or until the locking tab 18 is parallel to the main panel 16 and the 3D pop-up 12 is flattened or closed.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A locking mechanism for a 3D pop-up structure comprising:

a base panel attached to a lower surface of a 3D pop-up structure, the base panel having an opening at the center thereof;

a main panel which extends upward from and perpendicular to the base panel and into an internal cavity of the 3D pop-up structure;

a locking tab which interlocks with the main panel such that the locking tab is partially movable with respect to the main panel;

one or more stopper mechanisms located within the internal cavity of the 3D pop-up structure and which are operative to limit the movement of the locking tab with respect to the main panel;

wherein the locking tab is operative to move and retain the 3D pop-up into a fully erect position.

2. The locking mechanism of claim 1, wherein there are two locking tabs at opposite sides of the 3D pop-up structure.

3. The locking mechanism of claim 1, wherein the locking tab is accessed through the opening in the base panel.

4. The locking mechanism of claim 1, wherein the locking tab is operative to move between a first position wherein it is parallel with the main panel and a second position wherein it is perpendicular to the main panel.

5. The locking mechanism of claim 1, wherein the locking tab can be turned in a clockwise direction to retain the 3D pop-up structure in a fully erect position.

6. The locking mechanism of claim 1, wherein the locking tab can be turned in a counterclockwise direction to collapse the 3D pop-up structure.

7. The locking mechanism of claim 1, wherein the 3D pop-up structure is free-standing.

8. A pop-up greeting card with lock mechanism comprising:

a pop-up structure that is operable to move between a first position wherein the pop-up structure is in a substantially flat or two-dimensional configuration and a second position wherein the pop-up structure is in an erect three-dimensional configuration;

a lock mechanism attached to a bottom surface of the pop-up structure, the lock mechanism comprising a base panel, a main panel which extends upward from the base panel, and a locking tab which is attached to the main panel;

wherein when the pop-up structure is in the first position, the locking tab is parallel with the main panel and when the pop-up structure is in the second position, the locking tab can be moved such that it is perpendicular to the main panel and therefore retain the pop-up structure in the second position; and wherein the main panel of the lock mechanism extends into an inner cavity of the pop-up structure.

9. The pop-up greeting card with lock mechanism of claim 8, wherein the pop-up can be moved back to the first position by moving the locking tab in a counterclockwise direction.

10. The pop-up greeting card with lock mechanism of claim 8, wherein the 3D pop-up structure is in cylindrical form.

11. The pop-up greeting card with lock mechanism of claim 8, wherein the 3D pop-up structure is formed as a tiered cake.

12. The pop-up greeting card with lock mechanism of claim 8 further comprising one or more stop tabs which control the movement of the lock mechanism with respect to the main panel.

13. The pop-up greeting card with lock mechanism of claim 12, wherein the one or more stop tabs are substantially t-shaped.

14. The pop-up greeting card with lock mechanism of claim 8, wherein the locking tab is operative to move in a clockwise direction to lock the pop-up structure in the second position and a counterclockwise direction to return the pop-up structure to the first position.

15. A pop-up greeting card comprising:

a pop-up structure;

a lock mechanism contained within the pop-up structure, the lock mechanism comprising a base, a main panel attached to the base and a lock tab which is in contact with the main panel;

wherein the pop-up structure can move between a first position wherein it is folded and substantially flat and a second position wherein the pop-up structure is unfolded and fully erect; and wherein the lock tab can be moved from a first position wherein it lies flat within the pop-up structure and parallel with the main panel and a second position wherein it is perpendicular to the main panel and it retains the pop-up structure in the second position; and;

wherein the main panel of the pop-up structure extends into an internal cavity of the pop-up structure.

16. The pop-up greeting card of claim 15, further comprising one or more stoppers which restrict the movement of the lock tab with respect to the main panel.

17. The pop-up greeting card of claim 15 wherein the lock tab can be moved clockwise to retain the pop-up structure in the second position and counterclockwise to return the pop-up structure to the first position.

18. The pop-up greeting card of claim 15, wherein the pop-up structure can be moved to the second position by gently squeezing opposing sides of the pop-up structure.

* * * * *